US006883442B1

(12) United States Patent
Groszek et al.

(10) Patent No.: US 6,883,442 B1
(45) Date of Patent: Apr. 26, 2005

(54) PROCESS FOR THE PRODUCTION OF A GASEOUS FUEL

(75) Inventors: Martin Alexander Groszek, Newbury (GB); Christopher Edward Dodson, Reading (GB); Cornelis Wilhelmus Notebaart, JA Dieren (NL); Hubertus Petrus Maria Oudenhoven, GH Westervoort (NL)

(73) Assignee: Mortimer Technology Holdings Ltd., Reading (GB)

( * ) Notice: Subject to any disclaimer, the term of this patent is extended or adjusted under 35 U.S.C. 154(b) by 0 days.

(21) Appl. No.: 10/110,763

(22) PCT Filed: Oct. 25, 2000

(86) PCT No.: PCT/GB00/04106

§ 371 (c)(1),
(2), (4) Date: Sep. 16, 2002

(87) PCT Pub. No.: WO01/30943

PCT Pub. Date: May 3, 2001

(30) Foreign Application Priority Data

Oct. 25, 1999 (GB) ..... 9925199

(51) Int. Cl.[7] ..... F23B 7/00; F23G 7/00; B01J 8/18

(52) U.S. Cl. ..... 110/341; 110/204; 110/243

(58) Field of Search ..... 422/139, 145, 422/146, 147, 234; 110/101 R, 104 R, 204, 243, 244, 245; 48/197 R, 197 FM, 210; 922/234

(56) References Cited

U.S. PATENT DOCUMENTS 3,411,465 A * 11/1968 Shirai ..... 110/8
3,799,077 A * 3/1974 Lowe ..... 110/8 R
3,920,417 A * 11/1975 Fernandes ..... 48/197 R
4,023,280 A * 5/1977 Schora et al. ..... 34/10
4,191,539 A * 3/1980 Patel et al. ..... 48/210
4,197,092 A * 4/1980 Bretz ..... 48/86 R
4,248,164 A * 2/1981 Isheim ..... 110/225
4,298,453 A * 11/1981 Schoennagel et al. ..... 208/10
4,315,758 A * 2/1982 Patel et al. ..... 48/197 R
4,388,877 A * 6/1983 Molayem et al. ..... 110/342
4,451,184 A * 5/1984 Mitchell ..... 406/105
4,479,920 A 10/1984 Dodson
4,568,362 A 2/1986 Deglise et al. ..... 48/209
4,646,637 A * 3/1987 Cloots ..... 110/245
5,033,205 A 7/1991 Dodson
5,582,118 A 12/1996 Atkins et al.
5,829,368 A * 11/1998 Cote et al. ..... 110/342

FOREIGN PATENT DOCUMENTS

| | | |
|---|---|---|
| DE | 12 96 732 B | 6/1969 |
| DE | 15 71 650 A | 1/1971 |
| DE | 27 21 237 A | 12/1977 |
| DE | 29 42 804 A | 5/1981 |
| EP | 0 092 622 A1 | 2/1983 |
| NL | 8 701 523 A | 1/1989 |
| WO | WO 95/17982 | 6/1995 |

* cited by examiner

*Primary Examiner*—Kenneth Rinehart
(74) *Attorney, Agent, or Firm*—Bacon & Thomas, PLLC

(57) ABSTRACT

A process for the production of a gaseous fuel from a waste material and/or a premium fuel, which process comprises: i) providing a processing chamber having therein a plurality of outwardly radiating inclined vanes at a base thereof, an inlet and an outlet; ii) introducing a waste material and/or a premium fuel into the chamber through the inlet; iii) generating an upward flow of a heating fluid through the vanes at the base of the chamber, whereby the waste material and/or the premium fuel circulate about an axis of the chamber in a compact turbulent band and is gasified and/or pyrolysed to produce a gaseous fuel stream, which gaseous fuel stream exits the chamber through the outlet; and iv) feeding at least a portion of the gaseous fuel stream back into the chamber through an entry point adjacent the vanes.

24 Claims, 6 Drawing Sheets

SINGLE STAGE MULTIPLE GAS PASS CONFIGURATION

TWO STAGE MULTIPLE GAS PASS CONFIGURATION

TRIPLE STAGE MULTIPLE GAS PASS CONFIGURATION, (FEATURING TAR CRACKER AND GAS COOLING)

PROCESS FOR THE PRODUCTION OF A GASEOUS FUEL

The present invention relates to a process for the treatment of waste materials and/or premium fuels for the purpose of producing a gaseous fuel.

A number of different processes are known for the recovery of heat values from waste materials. For example, domestic and factory waste materials such as clean wood, agricultural waste, refuse-derived fuel, municipal solid waste and sewage sludge may be treated using a bubbling fluidised bed, a circulating fluidised bed, a fast fluidised bed, a pressurised fluidised bed, a moving bed or a moving grate. The main disadvantages of these processes are capital costs, flexibility and tar production. Flexibility is a particularly important issue for plants handling waste materials, since the feed material is waste, as opposed to a premium fuel, and there will therefore be relatively large fluctuations in both its physical and chemical composition. To accommodate the nature of many waste materials, the processing unit will also need a high turndown ratio and the ability to come on/off stream at relatively short notice. In addition it may be necessary to run the facility on more than one waste stream to make investment in such a system economic.

Additionally, tar production is a major problem for many existing gasification units. If the organic materials present in the waste are not cracked to simple molecules during the treatment process, they exist with the product gas stream and cause major downstream problems. These problems arise when the process gas temperature or that of the wetted surfaces falls below the dew point of the compounds concerned, causing them to condense out on surfaces forming liquids which then cause problems ranging from equipment fouling to occupational health issues. In addition, liquid tars are difficult to dispose of and can even cause a more serious disposal problem than that posed by the original waste material.

Most conventional process systems include a unit known as a tar cracker whose function is to augment the action of the gasifier and break down the large organic molecules into smaller ones which have higher dew points. Despite the additional capital costs and complexity associated with supplementary tar crackers, the occurrence and hence the problems associated with tar are not fully eliminated because the conventional processes are generally based on a single gas pass, hence the degree of tar cracking that can be achieved economically is limited.

Recycling gases leaving the processor to produce cracking of the contained tars within the process reactor itself have not been feasible owing to the high pressure drop across the conventional process reactors. To alleviate this problem would necessitate the use of expensive supplemental pumping systems which themselves would be liable to fouling from condensed tars.

In our European Patent No. 0 068 853 is described and claimed a process whereby a particulate material to be treated is embedded and centrifugally retained within a compact, but turbulent, toroidal bed of further particles which circulate about an axis of the processing chamber. Specifically, the resident or host particles within the bed are circulated above a plurality of outwardly radiating, inclined vanes arranged around the base of the processing chamber. The vanes are preferably arranged in overlapping relationship and the particles are caused to circulate around the bed by the action of a processing fluid, for example a gas injected into the processing chamber from beneath and through the vanes.

The present invention aims to address at least some of the problems associated with the prior art processes for the treatment of waste materials, and to furthermore provide a process which can also be used to treat premium fuels such as coal and petrochemical derivatives, plastics and residues from refineries.

Accordingly, in a first aspect the present invention provides a process for the production of a gaseous fuel from a waste material and/or a premium fuel, which process comprises:

(i) providing a processing chamber having therein a plurality of outwardly radiating inclined vanes at a base thereof, an inlet and an outlet;

(ii) introducing a waste material and/or a premium fuel into the chamber through the inlet;

(iii) generating an upward flow of a heating fluid through the vanes at the base of the chamber, whereby the waste material and/or the premium fuel circulates about an axis of the chamber in a compact turbulent band and is gasified and/or pyrolysed to produce a gaseous fuel stream, which gaseous fuel stream exits the chamber through the outlet; and (iv) feeding at least a portion of the gaseous fuel stream back into the chamber through an entry point adjacent the vanes.

In the process of the present invention, organic compounds in the waste material and/or the premium fuel are heated to a temperature sufficient to cause decomposition thereof, i.e. to cause pyrolysis. In this manner, the material being treated may be converted into or becomes a gas by gasification.

A portion or all of the gaseous fuel stream which has exited the chamber is advantageously reintroduced into the chamber at an entry point adjacent the vanes. By recycling typically from 10 to 100% by volume, more typically from 60 to 90%, still more typically from 75 to 85%, still more typically approximately 80% of the gaseous fuel stream exiting the chamber, it is possible to both increase and control the energy content of the gaseous fuel stream eventually exported. It will be appreciated that some or all of the gaseous fuel stream may be recycled through the chamber one or more times before finally being collected for use or for further processing. During each processing cycle, a portion of the gaseous fuel stream which has exited the chamber can be collected, whilst the remainder can be reintroduced into the chamber. Also, one or more passes of the gaseous fuel stream through the hot zone beneath the vanes facilitates the breakdown of large organic molecules. At elevated temperatures, and preferably in the presence of steam, many components of tar undergo shift reactions, in which the large organic molecules are split down into smaller molecules. By reducing the content of tar compounds exhausted, the need for a separate tar cracking unit operation can be obviated. In this regard, the pressure drop across a reactor, such as that described and claimed in EP-B-0 068 853, is small in comparison with other gas-solid contacting unit operations because the reactor has a high free area distributor and shallow bed of material which provide a pressure drop much lower (of an order of magnitude) than conventional fluid beds. Pressure drops through such a reactor are typically in the range of from 100 to 400 Pa, more typically 200 to 300 Pa. This attribute is beneficial because it enables the option of non-mechanical recycling of the hot exhaust gaseous fuel stream. The gaseous fuel stream may be reintroduced into the chamber at an entry point below the vanes of the chamber through, for example, one or more venturi inlets positioned below the vanes. Such inlets produce increased gas velocities within the chamber resulting in more efficient circulation of the material being treated and of any inert or catalytic material present in the chamber, which, in the latter case, produces greater contact with the material being treated and process gases. Alternatively, a portion or all of the gaseous fuel stream may be reintroduced in the chamber by mixing it with the heating fluid prior to its entry into the chamber.

Advantageously, a gas-solid separator is provided in the recycle loop to prevent fouling of the distributor before feeding a portion of the gaseous fuel stream back into the chamber. This function may be performed by any suitable gas-solid separation technique such as, for example, a conventional reverse flow cyclone separator or a rotary separators.

Once at least a portion of the gaseous fuel stream has been recycled through the chamber at least one time, it may be collected and stored ready for use. Alternatively, one or more of the following further processing steps may be carried out: particulate removal using, for example, a cyclone or baghouse; drying to remove, for example, motive and reaction steam using, for example, alumina beads and/or a condenser; compression to reduce the cost of transporting the gas to its final destination by, for example, a compressor or an in-line gas booster; and/or sweetening to remove any acid gases remaining in the gaseous fuel.

The inlet for the waste material and/or the premium fuel will generally be located adjacent the base of the chamber and the outlet will generally be spaced downstream from the inlet. The inlet is preferably located at a position above the vanes of the chamber. The outlet will generally be vertically spaced above the inlet of the processing chamber, although the inlet may be located adjacent thereto. Both the inlet and the outlet may be provided in a top portion of the chamber.

The material to be treated may be introduced into the processing chamber by injecting it through the inlet under the influence of a compressed gas such as compressed air and/or an inert gas such as nitrogen, CFC and other noble/mono-atomic gases. The material to be treated may also be injected with steam. In one preferred embodiment of the present invention, the inlet is located above the vanes at the base of the chamber and the material to be treated is introduced into the chamber by a gravity feed mechanism, for example using an air lock device such as a rotary valve. The gravity feed mechanism may be provided in a vertical wall of the chamber.

The waste material to be treated may comprise domestic and factory waste materials including solid and/or liquid materials such as, for example, waste wood, wood shavings, agricultural waste, animal litter, refuse-derived fuel, municipal solid waste and sewage sludge. The process of the present invention may also be used to treat fuels such as premium fuels, for example coal, petrochemical derivatives, residues from refineries and plastics.

The gaseous fuel produced by the process of the present invention will generally have the following characteristics:

| | |
|---|---|
| Calorific Value MJ/m$^3$ | 10–15 |
| Composition by Volume | |
| $CO_2$ | 20–30 |
| CnHm | 2–4 |
| CO | 25 |
| $CH_4$ | 12–14 |
| $H_2$ | 20–35 |
| $N_2$ | 6–10 |

The values quoted in the table above relate to the use of oxygen, rather than air, for the combustion of the organics. The use of substantially pure oxygen or oxygen-enriched gases minimises the quantity of nitrogen in the final fuel gas stream therefore improving its quality.

It will be appreciated that the flow of heating fluid may be generated either before or after the material to be treated is introduced into the chamber. Alternatively, the flow of heating fluid may be generated at the same time as the material to be treated is introduced into the chamber.

The heating fluid may comprise steam or a gas stream produced by the direct combustion of a fuel. In the latter case, the combustion product of a suitable fuel will generally have the following composition:

| Component | Volume % (Wet Basis) |
|---|---|
| $CO_2$ | 10 |
| $N_2$ | 72% |
| $H_2O$ | 18% |

Heated air and/or a heated inert gas may also be used. Heating may be achieved by any suitable means, such as electrical and/or microwave heating means. Steam is advantageously used because it enhances the cracking of tars present in the gaseous fuel stream resulting from treatment of the waste material and/or premium fuel. Separate heating means may also be provided for heating the processing chamber and its contents.

The heating fluid is typically heated to a temperature in the range of from 200 to 1100° C., depending upon the nature of the material to be treated. More typically, the heating fluid is heated to a temperature in the range of from 300 to 1000° C., still more typically from 400 to 900° C.

The flow of the heating fluid through the chamber may be generated in a manner as described in EP-B-0 382 769 and EP-B-0 068 853, i.e. by supplying a flow of heated fluid into and through the processing chamber and directing the flow by means of the plurality of outwardly radiating and preferably overlapping vanes arranged in the form of a disc and located at or adjacent to the base of the processing chamber. The vanes are inclined relative to the base of the chamber so as to impart rotational motion to the heating fluid entering the chamber, hence causing the heating fluid to circulate about a substantially vertical axis of the chamber as it rises.

In a preferred embodiment of the process according to the present invention, the processing chamber contains a resident bed of particulate material which circulates about an axis of the chamber when the flow of the heating fluid is generated. The average density of the particles of the resident bed is such that there is little or substantially no migration thereof to the outlet. The circulating resident bed particles provide a turbulent environment within which gas/particles heat and mass transfer properties are enhanced. This consequently enhances heat transfer to the material to be treated. A tortuous/labyrinthine flow type path is provided, which increases the effective residence time of the material to be treated in the processing chamber, hence increasing the time for gasification and/or pyrolysis. The circulating resident bed of particles may also act as a heat sink. The material to be treated will generally enter the chamber below and/or adjacent to the circulating resident bed particles in order to contact therewith. Alternatively, if the inlet is vertically spaced above the vanes at the base of the chamber and the circulating resident bed, then the material to be treated will fall down through the chamber, under the action of gravity, on to the circulating resident bed. This may be achieved by, for example, a gravity feed mechanism provided in a vertical wall of the chamber.

In general, the average terminal velocity of a resident bed particle will be greater than the average terminal velocity of a particle of the material to be treated, prior to the latter being introduced in the chamber. However, the process of the present invention may also be used in circumstances where the terminal velocity of the particles of the material to be treated decreases during processing.

The particulate material of the resident bed may comprise an inert material, which acts to increase the time spent by the material to be treated in the processing chamber. Suitable examples include one or more of sand, alumina, and/or ash from the material being processed (autogenous). Alternatively, the particulate material may comprise a solid absorbent material for the additional purpose of removing acidic gases, such as hydrochloric acid, hydrofluoric acid and/or sulphuric acid, from the gaseous fuel stream before it exits the processing chamber. Suitable examples include ceramics, alumina, silica, limestone and zeolite. The particulate material may alternatively or, in addition, comprise a catalytic material, for example a catalytic material such as dolomite, a nickel-bearing catalyst, a zeolite, a magnesium-calcium carbonate, a calcined magnesium-carbonate, which acts to increase the rate of tar cracking or decomposition in the exiting gaseous fuel stream. The resident bed particles may be replenished from time to time if required. The resident bed particles typically have an average size of from about 1 to 6 mm, more typically from about 2 to about 3 mm.

It will be appreciated that char (i.e. non-volatile components in the material to be treated) may be produced when carrying out the process of the present invention. Char and other non-volatile components may be removed from the chamber via a central discharge, which is preferably designed to differentiate char from the resident bed material. Alternatively, it may be removed with the exhaust gaseous fuel stream to be subsequently captured in a downstream gas processing stage, for example cyclone separation.

Gasification may be thought of as a generic term covering a number of individual reactions and process events including: drying, devolatilisation, char combustion, tar cracking (which can be catalysed by a resident bed). In some circumstances, each of these reaction/process events require different conditions, such as temperature, residence time and catalysing medium, for optimum performance. The use of multiple stages makes it possible to optimise the conditions for each reaction/process event. Accordingly, the processing chamber according to the first aspect of the present invention may comprise multiple (i.e. two or more) stages installed within a single reactor vessel, for example a drying and/or devolatilisation stage, a char combustion stage, and a tar cracking stage.

Alternatively, multiple (i.e. two or more) stages may be achieved by the use of multiple reactors connected in series. Accordingly, in a second aspect the present invention provides a process for the production of a gaseous fuel from a waste material and/or a premium fuel, which process comprises:

(i) providing first and second processing chambers, each chamber having therein a plurality of outwardly radiating inclined vanes at a base thereof, an inlet and an outlet;
(ii) introducing a waste material and/or a premium fuel into the first chamber through the inlet thereof;
(iii) generating an upward flow of a heating fluid through the vanes at the base of the first chamber, whereby the waste material and/or the premium fuel circulate about an axis of the first chamber in a turbulent band and is heated to produce a gaseous fuel stream and char, said gaseous fuel stream exiting the first chamber through the outlet thereof;
(iv) feeding at least a portion of the gaseous fuel stream into the second chamber through an entry point adjacent the vanes;
(v) feeding at least a portion of char generated in the first chamber into the second chamber through the inlet thereof;
(vi) generating an upward flow of a heating fluid through the vanes at the base of the second chamber, whereby the char circulates about an axis of the first chamber in a turbulent band and is heated in a char combustion step to produce a gaseous fuel stream, which gaseous fuel stream exits the second chamber through the outlet thereof; and
(vii) optionally feeding at least a portion of the gaseous fuel stream from the second chamber back into the first chamber through an entry point adjacent the vanes.

Additionally, in a third aspect, the present invention provides a process for the production of a gaseous fuel from a waste material and/or a premium fuel, which process comprises:

(i) providing first, second and third processing chambers, each chamber having therein a plurality of outwardly radiating inclined vanes at a base thereof, an inlet and an outlet;
(ii) introducing a waste material and/or a premium fuel into the first chamber through the inlet thereof;
(iii) generating an upward flow of a heating fluid through the vanes at the base of the first chamber, whereby the waste material and/or the premium fuel circulate about an axis of the first chamber in a turbulent band and is heated to produce a gaseous fuel stream and char, said gaseous fuel stream exiting the first chamber through the outlet thereof;
(iv) feeding at least a portion of the gaseous fuel stream into the third chamber through an entry point adjacent the vanes thereof;
(v) feeding at least a portion of char generated in the first chamber into the second chamber through the inlet thereof;
(vi) generating an upward flow of a heating fluid through the vanes at the base of the second chamber, whereby the char circulates about an axis of the first chamber in a turbulent band and is heated in a char combustion step to produce a gaseous fuel stream, which gaseous fuel stream exits the second chamber through the outlet thereof;
(vii) generating an upward flow of a heating fluid through the vanes at the base of the third chamber, whereby said at least portion of the gaseous fuel stream from the first chamber circulates about an axis of the third chamber in a turbulent band and is heated in a tar cracking step to produce a gaseous fuel stream, which gaseous fuel stream exits the third chamber through the outlet thereof;
(viii) optionally feeding at least a portion of the gaseous fuel stream from the third chamber back into the second chamber through an entry point adjacent the vanes; and
(ix) optionally feeding at least a portion of the gaseous fuel stream from the second chamber back into the first chamber through an entry point adjacent the vanes.

It will be appreciated that the preferred and advantageous features described herein in relation to the first aspect of the present invention are equally applicable either singularly or in any combination to the second and third aspects.

The present invention also provides an apparatus for carrying out the process of the first, second or third aspects as herein described.

The present invention will now be described further, by way of example, with reference to the accompanying drawings, in which:

FIG. 1 is a schematic illustration of an apparatus suitable for carrying out one embodiment of the process according to the invention;

FIG. 1*a* is a perspective view of an arrangement of vanes in one embodiment of the present invention;

Figure 1:
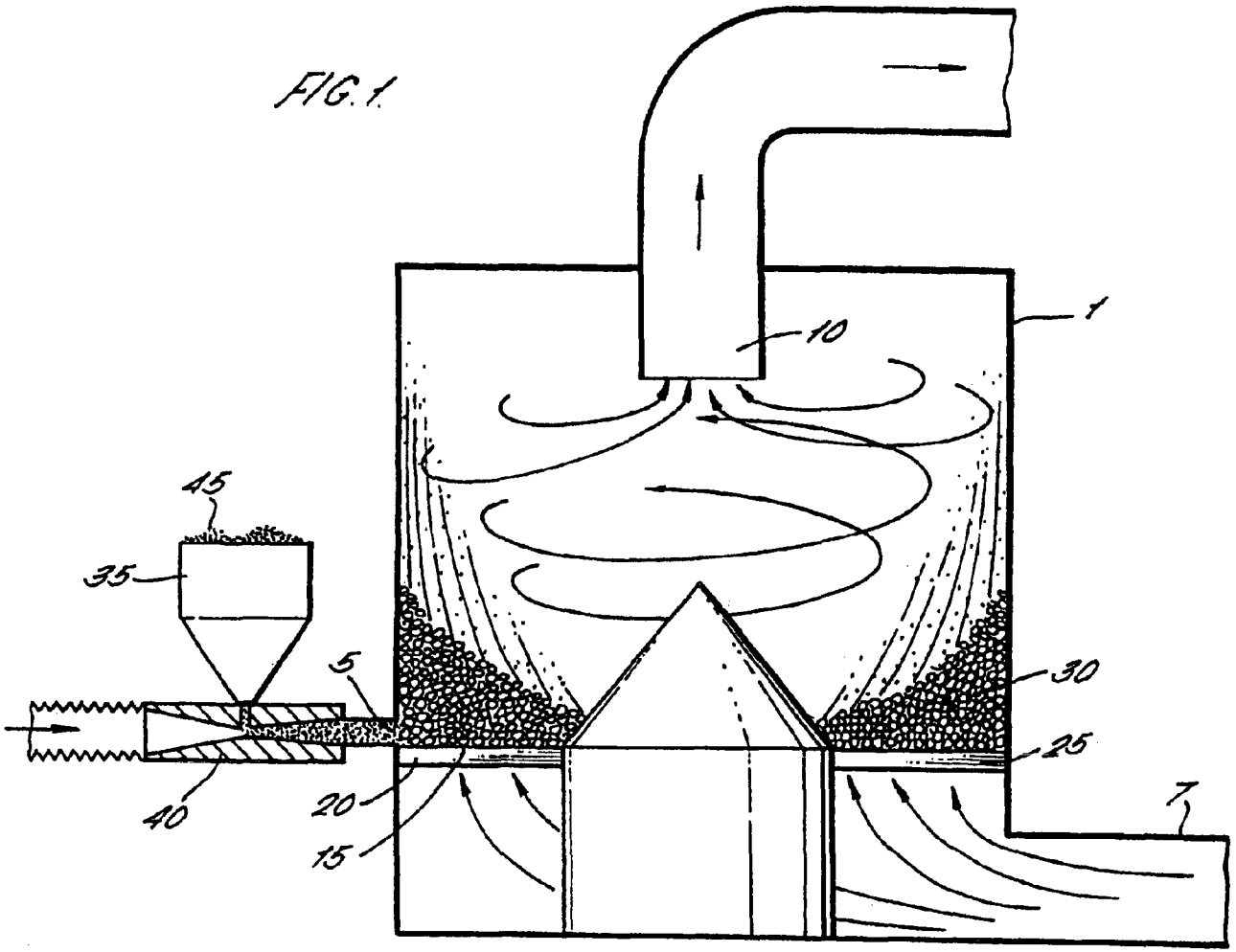

In FIG. 1, a generally cylindrical processing chamber 1 is shown suitable for carrying out the process according to the present invention. The processing chamber 1 has an inlet 5 and an outlet 10 spaced downstream therefrom. At the base 15 of the chamber 1 there is provided a circular arrangement of overlapping vanes, wherein each vane is inclined relative to the base. Two vanes are shown at 20 and 25. The vanes 20, 25 radiate outwardly from a central point towards the vertical wall of the chamber and form part of a circular disc. A flow of a heating fluid, for example steam, enters the chamber via an inlet 7 and passes through the vanes 20, 25 at the base 15 of the chamber 1. The arrangement of the vanes 20, 25 imparts rotational motion to the heating fluid entering the chamber 1 so that the heating fluid circulates about a substantially vertical axis of the chamber 1 as it rises. By this process, the heating fluid swirls around the chamber 1 in a turbulent fashion and then exhausts from the chamber via outlet 10.

Figure 1A:
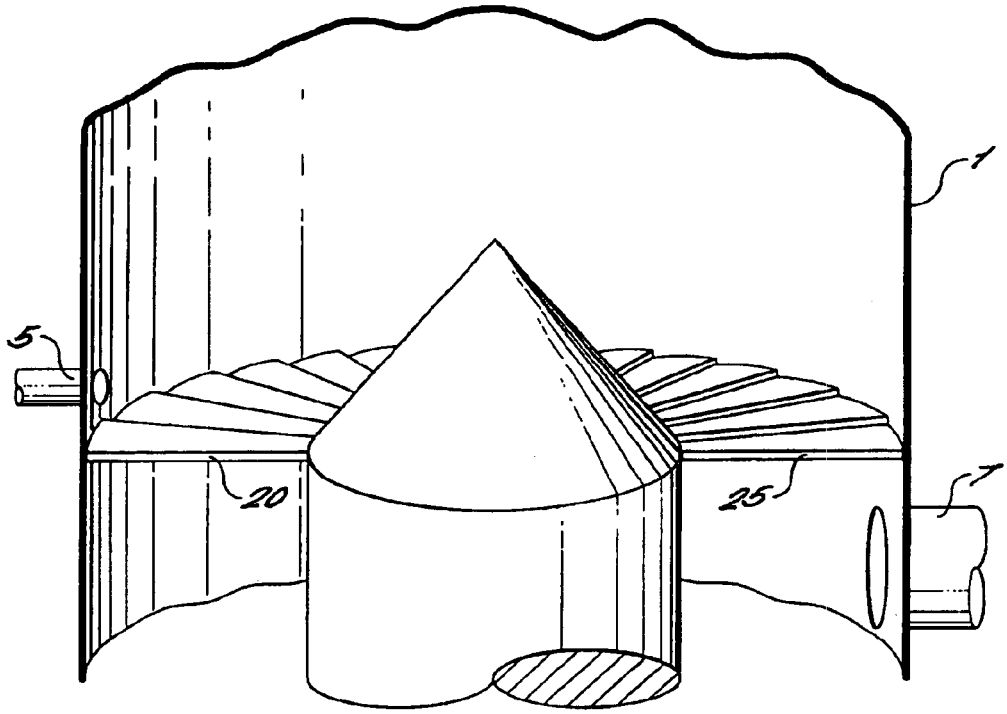

The arrangement of the vanes is more clearly shown in the perspective view shown in FIG. 1*a*, where there is shown a plurality of outwardly radiating incline vanes 20, 25 at the base 15 of chamber 1, which impart a rotational motion to the heating fluid to circulate the heating fluid about a substantially vertical axis of the chamber 1 as the fluid rises.

A resident bed of particles 30 resides in the chamber 1. The particulate material of the resident bed 30 may comprise, for example, a solid absorbent material for the purpose of removing acidic gases and/or a catalytic material for the purpose of increasing the rate of tar decomposition.

A feed hopper 35 and venturi arrangement 40 are provided to supply, for example, a waste material 45 to be treated, under compressed air injection, through the inlet 5 into the chamber 1. As the flow of heating fluid is generated through the vanes 20, 25 at the base 15 of the chamber 1, the resident bed particles 30 circulate about a substantially vertical axis of the chamber 1 in an annular region thereof. The waste material to be treated 45 is then injected into the chamber 1 and contacts immediately or almost immediately with the circulating resident bed particles 30. Because of their size and density, there is little or substantially no migration of the resident bed particles 30 to the outlet 10.

In this manner, substantially all of the waste material 45 is gasified and/or pyrolysed resulting in a gaseous fuel stream which flows downstream through the circulating resident bed particles 30, whereby acidic gases are removed and/or the rate of tar decomposition is increased depending upon the nature of the resident bed particles 30. Thereafter, the gaseous fuel stream exits the chamber through the outlet 10, where a portion may be collected and stored. The remaining portion of the gaseous fuel stream which has exited the chamber 1 is reintroduced into the chamber 1 through, for example, one or more venturi inlets (not shown) positioned below the vanes 20, 25. Alternatively, the remainder of the gaseous fuel stream may be fed into inlet 7 to mix with the heating fluid prior to entry into the chamber 1. By recycling some or all of the gaseous fuel stream exiting the chamber 1, it is possible to increase and control the energy content of the gaseous fuel stream eventually exported. Also, multiple passes of the gaseous fuel stream through the hot zone beneath the vanes 20, 25 helps breakdown large organic molecules. Because of the relatively low pressure drop through the chamber, the gaseous fuel stream may be fed directly back into the chamber 1 without recourse to supplemental pumping means.

Figure 2:
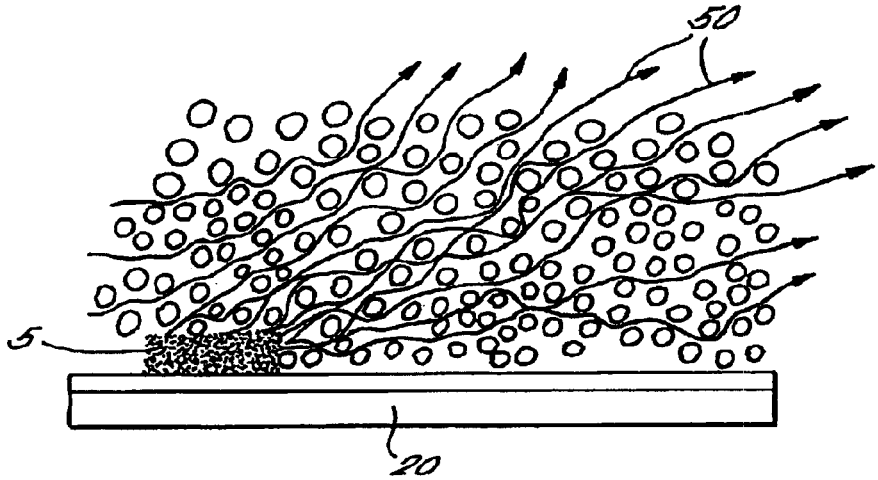
FIG. 2 is a schematic illustration of the trajectories of particles of material to be treated through a circulating resident bed of particles.

In FIG. 2 trajectories 50 of the particles of a waste material to be treated 45 are shown. It can be seen that the circulating resident bed particles 30 provides torturous/labyrinthine paths for the particles of the waste material to be treated 45. Accordingly, the resident bed particles 30 not only act to remove acidic gases and/or increase the rate of tar decomposition in the gaseous fuel stream, but also have the effect of increasing the time the waste material spends in the chamber, hence achieving a greater degree gasification and/or pyrolysis.

Figure 3:
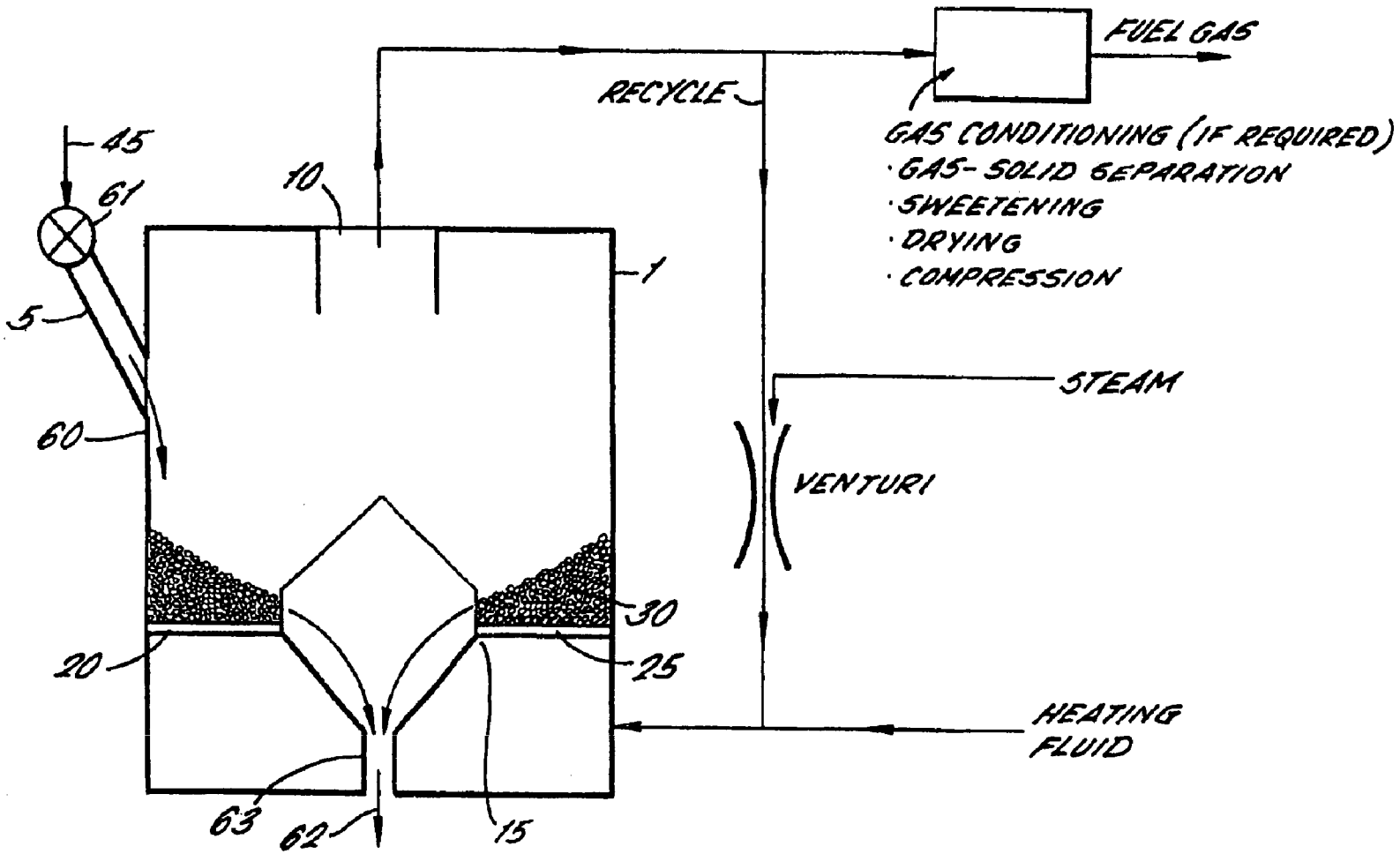
FIG. 3 is a schematic illustration of an alternative form of the apparatus suitable for carrying out one embodiment of the process according to the invention.

FIG. 3 illustrates an alternative form of the apparatus suitable for carrying out the process according to the present invention. It can be seen that in this embodiment the inlet for the material to be treated is provided in a vertical wall 60 of the chamber and is vertically spaced from the resident bed particles 30 and the vanes 20, 25 at the base of the chamber. The material to be treated 45 is thus introduced into the chamber 1 by a gravity feed mechanism which includes an air lock, for example a rotary valve 61. Accordingly, in use, the material to be treated 45 will fall down through the chamber 1, under the action of gravity, on to the circulating resident bed particles 30. Char 62 and other non-volatile components in the material to be treated 45 are removed from the chamber 1 via a central discharge 63, which is designed to differentiate char 62 from the resident bed material 30.

Figure 4A:
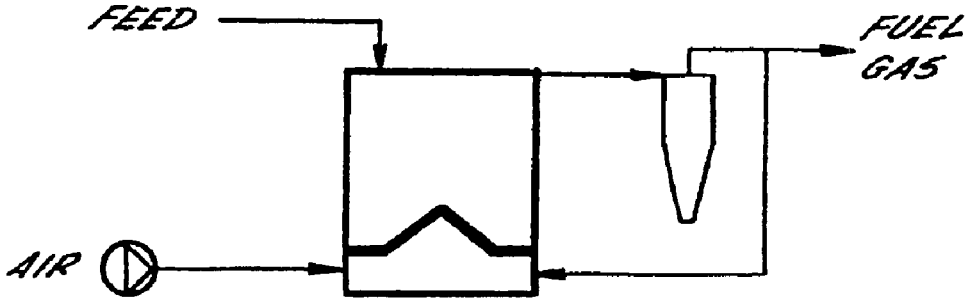
FIGS. 4(*a–c*) are schematic illustrations to show: (a) single stage multiple gas pass configuration, (b) double stage multiple gas pass configuration, and (c) triple stage multiple gas pass configuration.
Figure 4B:
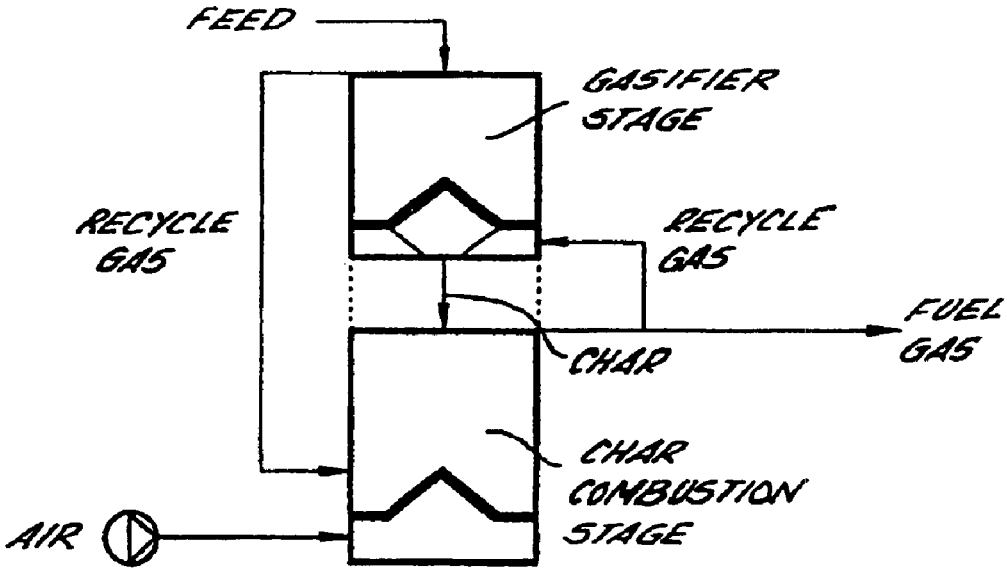
Figure 4C:
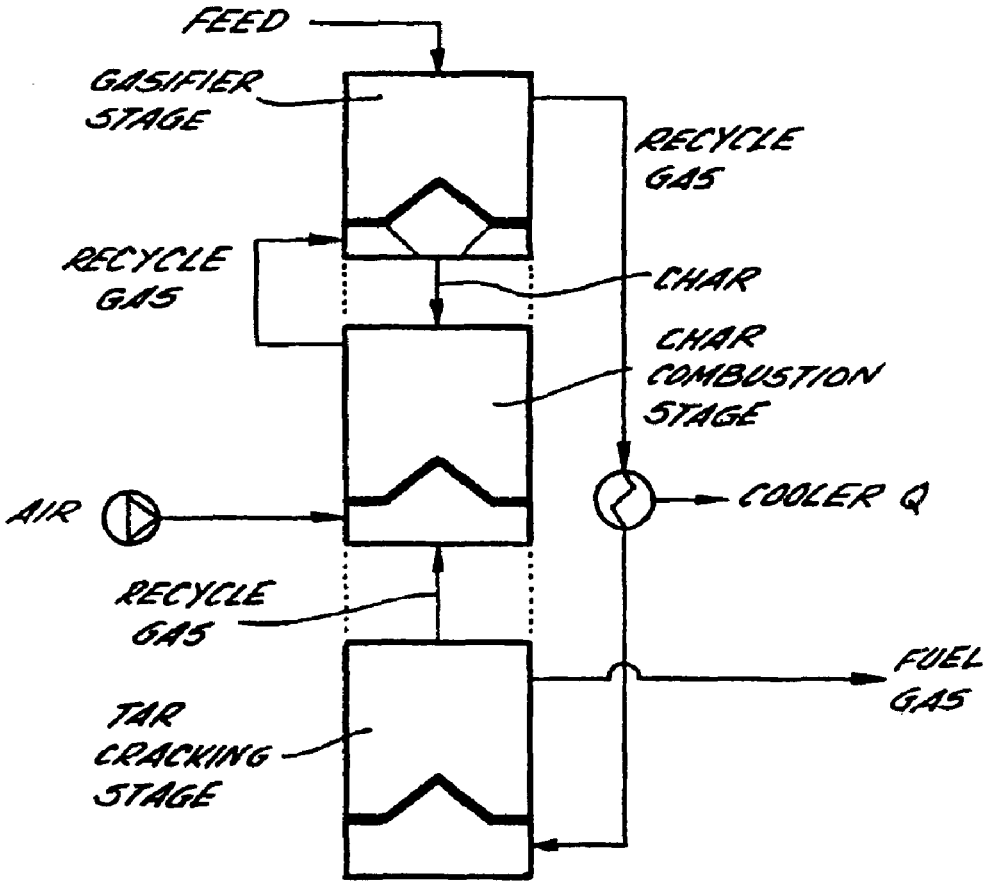

FIGS. 4(*a–c*) are schematic illustrations to show: (a) single stage multiple gas pass configuration, (b) double stage multiple gas pass configuration, and c) triple stage multiple gas pass configuration. As previously indicated, gasification may be thought of as a generic term covering a number of individual reactions and process events including: drying, devolatilisation, char combustion, tar cracking (which can be catalysed by a resident bed). While it is, of course, possible to carry out gasification according to the present invention in a single chamber as shown in FIG. 4(*a*), for some applications it may be preferable for the reaction/process events to be carried out in separate chambers. The use of multiple stages makes it possible to optimise the conditions for each reaction/process event.

FIG. 4(*b*) shows a double stage configuration comprising a gasifier chamber and a char combustion chamber. The gasifier and char combustion chambers generally have the same features as the processing chambers described above and shown in FIGS. 1 and 2; the processing conditions in each are, however, adjusted to optimise the reaction/process events. The feed is introduced into the gasifier chamber, where it is heated to produce a gas and char. Heating in the gasifier chamber may also result in drying and/or devolatisation of the feed. The gas and char are then fed into the char combustion chamber, where they are further heated. At least a portion of the fuel gas thereby evolved in the char combustion chamber is fed back into the gasifier chamber. Heated air is passed through the vanes at the base of the char combustion chamber. The heated air, together with at least a portion of the fuel gas evolved may be used to provide or contribute to the heating fluid in the gasifier chamber. If desired, a separate source of heating fluid may also be introduced through the vanes at the base of the gasifier chamber.

By recycling typically from 10 to 100% by volume, more typically from 60 to 90%, still more typically from 75 to 85% of the gaseous fuel stream exiting the chamber, it is possible to both increase and control the energy content of the gaseous fuel stream eventually exported. It will be appreciated that some or all of the gaseous fuel stream from the char combustion chamber may be recycled through the gasifier chamber one or more times before finally being collected for use or for further processing. During each processing cycle, a portion of the gaseous fuel stream which has exited the char combustion chamber can be collected, whilst the remainder can be reintroduced into the gasifier chamber. Also, the gas recycle assists in producing the heating fluid in the two chambers.

FIG. 4(*c*) shows a triple stage configuration comprising a gasifier chamber, a char combustion chamber and a tar cracking chamber. The chambers generally have the same features as the processing chambers described above and shown in FIGS. 1 and 2; the processing conditions in each are, however, adjusted to optimise the reaction/process events. The feed is introduced into the gasifier chamber, where it is heated to produce a gas and char. The gas and char are then fed respectively into tar cracking chamber and the char combustion chamber, where they are further heated. At least a portion of the fuel gas thereby evolved in the char combustion chamber is fed back into the gasifier chamber. Heated air is passed through the vanes at the base of the char combustion chamber. The heated air, together with at least a portion of the fuel gas evolved may be used to provide or contribute to the heating fluid in the gasifier chamber. If desired, a separate source of heating fluid may also be introduced through the vanes at the base of the gasifier chamber. At least a portion of the fuel gas evolved in the tar cracking chamber may optionally be fed into the char combustion chamber. Again, the at least a portion of the fuel gas evolved may be used to contribute to the heating fluid in the char combustion chamber. Again, it will be appreciated that some or all of the gaseous fuel stream from the chambers may be recycled one or more times before finally being collected for use or for further processing. During each processing cycle, a portion of the gaseous fuel stream which has exited the tar cracking chamber can be collected, whilst the remainder can be reintroduced into the char combustion chamber and, in turn, into the gasifier chamber.

EXAMPLES

There is significant interest in premium fuel substitutes. While the heat value of these low and negative value wastes can be realized via straight combustion, the process intensity of a gas-solid reactor operated in this mode is limited by the differential of the gas temperature and the quantity of free water and ash present. On small to medium scale applications, process intensity is an important factor, which should ideally be maximized.

One way of increasing the process intensity is to gasify the organics within the feedstock and then burn them ex-situ as a fuel gas in an existing burner system. The following example involves the use of wood shavings, which are first gasified in a reactor system as herein described, and then used to fuel a burner attached to an existing rotary drier.

Example 1

Wood Shavings Gasification

This Example involves processing of fine waste wood dust to generate a fuel gas suitable for use in a close-coupled excess air burner.

Figure 5:
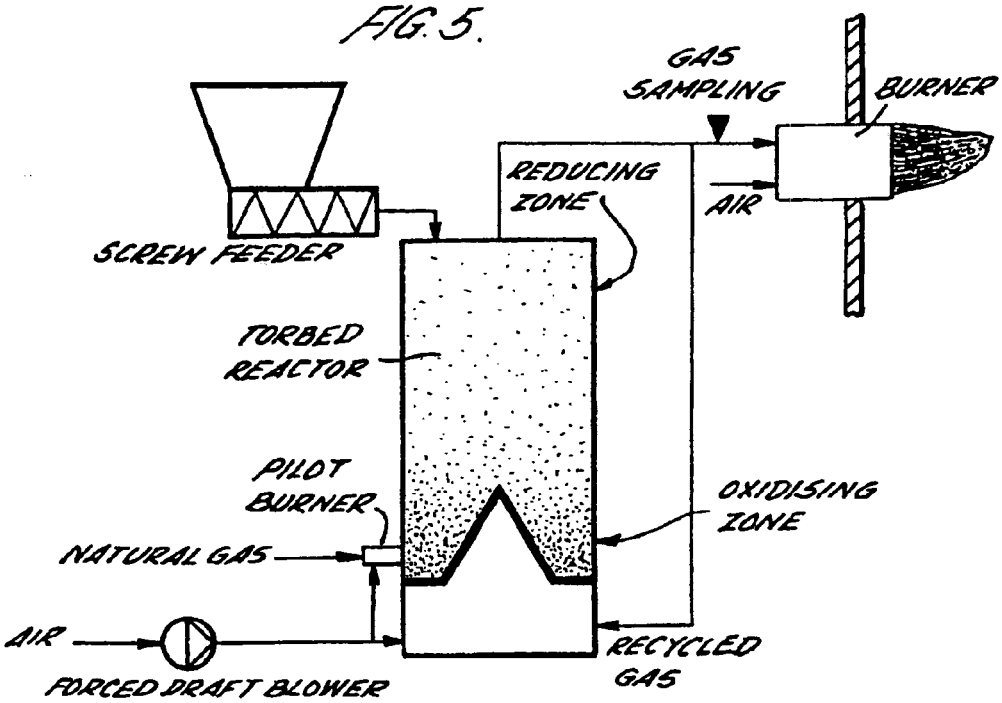
FIG. 5 is a schematic illustration of the general arrangement for Examples 1 and 2 given below.

The reactor was operated with an oxidising atmosphere in the lower (bed) region and a reducing atmosphere in the upper (freeboard) region (see FIG. 5). Feed material was metered into the freeboard of the reactor where it came into contact with hot process gases rising from the gas distributor at the base. In this reducing region of the reactor, the flash gasification process took place, generating the fuel gas and a residual char.

While the fuel gases were expelled from the reactor, the char particles continued their ascent to the bed region. As this region was operated with excess air, the char particles were substantially completely combusted to $CO_2$ and water to generate a reducing atmosphere and produced the heat needed to drive the gasification process in the freeboard above.

The gas passing through the distributor was ambient air and the interface between the reducing and oxidising regions within the furnace was controlled by manipulating the air and feed flow rates.

Tests were undertaken in a T400 (400 mm internal diameter) Torbed (RTM) reactor fitted with 30% free surface area blades. The flow rate of air passing through the unit was controlled via a frequency inverter fitted to the forced draught fan. Air flow rate was quantified by a portable hot-wire anemometer. Feed material was continuously metered into the Torbed reactor via a frequency inverter controlled screw conveyor, which had a nominal range of 30 kg/h to 300 kg/h. The unit was also fitted with a small pilot burner in the region just above the blades to facilitate start-up. Performance of the unit was gauged by the output of an on-line gas analyser combined with a subjective visual assessment of the flame in the rotary dryer fire-box and by the temperature profile in the Torbed reactor.

To prepare the system for gasification, the unit was started-up in combustion mode. This was achieved by operating at a sub-stoichiometric solids feed-rate with respect to the oxygen content of the fluidising air. The composition of the wood fines is given in Table 1-1 and the feed rate required for start-up was 30 kg/h. The small gas fired pilot burner was employed to initiate combustion.

TABLE 1-1

Composition (Typical) of Wood Shavings.

| Typical Composition | Mass % (as received basis) | Mass % (dry basis) |
|---|---|---|
| Moisture | 15 | — |
| Carbon | 42.5 | 50 |
| Hydrogen | 5.1 | 6 |
| Nitrogen | 0.9 | 1 |
| Oxygen | 36.6 | 43 |
| Heat Value | 15,800 kJ/kg | 19,000 kJ/kg |

Once the reactor was heat soaked to around 1000° C., operation was switched to gasification mode. This transition was achieved by simply increasing the solids feed-rate. Once the quantity of organics entering the reactor with the feed exceeded the amount of oxygen available for complete combustion, the atmosphere in the upper region of the reactor became reducing and the gasification process commenced. This change of operating mode was also accompanied by a reduction in temperature associated with the endothermic requirements of the gasification reactions. Further increases in feed-rate extend the reducing zone and increased the quality of the fuel gas.

At steady state, the flow rate of ambient air into the reactor was around 250 kg/h and the balancing solids feed-rate was around 140 kg/h. The resulting temperature in the lower section of the reactor was 744° C., while the temperature in the upper section was 738° C. A composite (21 measurements) assay of the gas produced under these conditions is given in Table 1-2.

TABLE 1-2

Exhaust gas composition-Wood Shavings Gasification Trial

| Component | Concentration (volume % dry basis) |
|---|---|
| CO | 15.2 |
| $CO_2$ | 14.9 |
| $CH_4$ | 2.9 |
| $H_2$ | 6.4 |
| $O_2$ | 0.3 |
| $N_2$ | 58.6 |
| $C_2H_4$ | 0.8 |
| $C_2H_6$ | 0.2 |
| $C_6H_6$ | 0.3 |
| $C_7H_8$ | 0.1 |

The calorific value of this gas was of sufficient quality to operate the close-coupled natural gas burner servicing a rotary dryer. The flame emanating from this burner was a very intense white colour with flecks of yellow caused by the carry-over of char particles. Upon completion of the trial, the reactor and duct work were inspected, however there were no signs of tar.

Example 2

Chicken Litter Gasification

The following example involves the use of chicken litter, which is first gasified in a Torbed (RTM) reactor based system, and then used to fuel a burner attached to an existing rotary drier.

The reactor was operated with an oxidising atmosphere in the lower (bed) region and a reducing atmosphere in the upper (freeboard) region (FIG. 5). Feed material was metered into the freeboard of the reactor where it came into contact with hot process gases rising from the gas distributor at the base. In this reducing region of the reactor, the flash gasification process took place generating the fuel gas and a residual char.

While the fuel gases were expelled from the reactor, the char particles continued their ascent to the bed region. As this region was operated with excess air, the char particles were completely combusted to $CO_2$ and water to generate a reducing atmosphere and produced the heat needed to drive the gasification process in the freeboard above.

The gas passing through the distributor was ambient air and the interface between the reducing and oxidising regions within the furnace was controlled by manipulating the air and feed flow rates.

Tests were undertaken in a T400 (400 mm internal diameter) Torbed (RTM) reactor fitted with 30% free surface area blades. The flow rate of air passing through the unit was controlled via a frequency inverter fitted to the forced draught fan. Air flow rate was quantified by a portable hot-wire anemometer. Feed material was continuously metered into the Torbed reactor via a frequency inverter controlled screw conveyor, which had a nominal range of 30 kg/h to 300 kg/h. The unit was also fitted with a small pilot burner in the region just above the blades to facilitate start-up.

Performance of the unit was gauged by the output of an on-line gas analyser combined with a subjective visual assessment of the flame in the rotary dryer fire-box and by the temperature profile in the Torbed reactor.

To prepare the system for gasification, the unit was started-up in combustion mode. This was achieved by operating at a sub-stoichiometric solids feed-rate with respect to the oxygen content of the fluidising air. The composition of the chicken litter is given in Table 2-1 and the feed rate required for start-up was 30 kg/h. The small gas fired pilot burner was employed to initiate combustion.

TABLE 2-1

Composition (Typical) of Chicken Litter

| Typical Composition | Mass % (as received basis) | Mass % (dry basis) |
|---|---|---|
| Moisture | 15 | — |
| Carbon | 40.2 | 47.3 |
| Hydrogen | 5.6 | 6.6 |
| Nitrogen | 4.6 | 5.4 |
| Oxygen | 31.1 | 36.6 |
| Sulphur | 0.6 | 0.7 |
| Heat Value | 15,800 kJ/kg | 19,000 kJ/kg |

Once the reactor was heat soaked to around 1000° C., operation was switched to gasification mode. This transition was achieved by simply increasing the solids feed-rate. Once the quantity of organics entering the reactor with the feed exceeded the amount of oxygen available for complete combustion, the atmosphere in the upper region of the reactor became reducing and the gasification process commenced. This change of operating mode was also accompanied by a reduction in temperature associated with the endothermic requirements of the gasification reactions. Further increases in feed-rate extend the reducing zone and increase the quality of the fuel gas.

At steady state, the flow rate of ambient air into the reactor was around 250 kg/h and the balancing solids feed-rate was around 145 kg/h. The resulting temperature in the lower section of the reactor was 800° C., while the temperature in the upper section was 766° C. A composite (91 measurements) assay of the gas produced under these conditions is given in Table 2-2.

TABLE 2-2

Exhaust gas composition-Chicken Litter Gasification Trial

| Component | Concentration (volume % dry basis) |
|---|---|
| CO | 11.1 |
| $CO_2$ | 17.1 |
| $CH_4$ | 3.1 |
| $H_2$ | 8.2 |
| $O_2$ | 0 |
| $N_2$ | 57.88 |
| $C_2H_4$ | 1.55 |
| $C_2H_6$ | 0.2 |
| $C_5H_6$ | 0.3 |
| $C_7H_8$ | 0.1 |

The calorific value of this gas was of sufficient quality to operate a close-coupled natural gas burner servicing a rotary dryer. The flame emanating from the burner was a very intense white colour with flecks of yellow caused by the carry-over of char particles. Upon completion of the trial, the reactor and duct work were inspected however there were no signs of tar.

Example 3

Sewage Gasification

The following example involves the processing of dried sewage (moisture content +70%) in a pilot plant configured with exhaust gas recycle. In this case, the fuel gas produced was flared in a dedicated after-burner unit.

Figure 6:
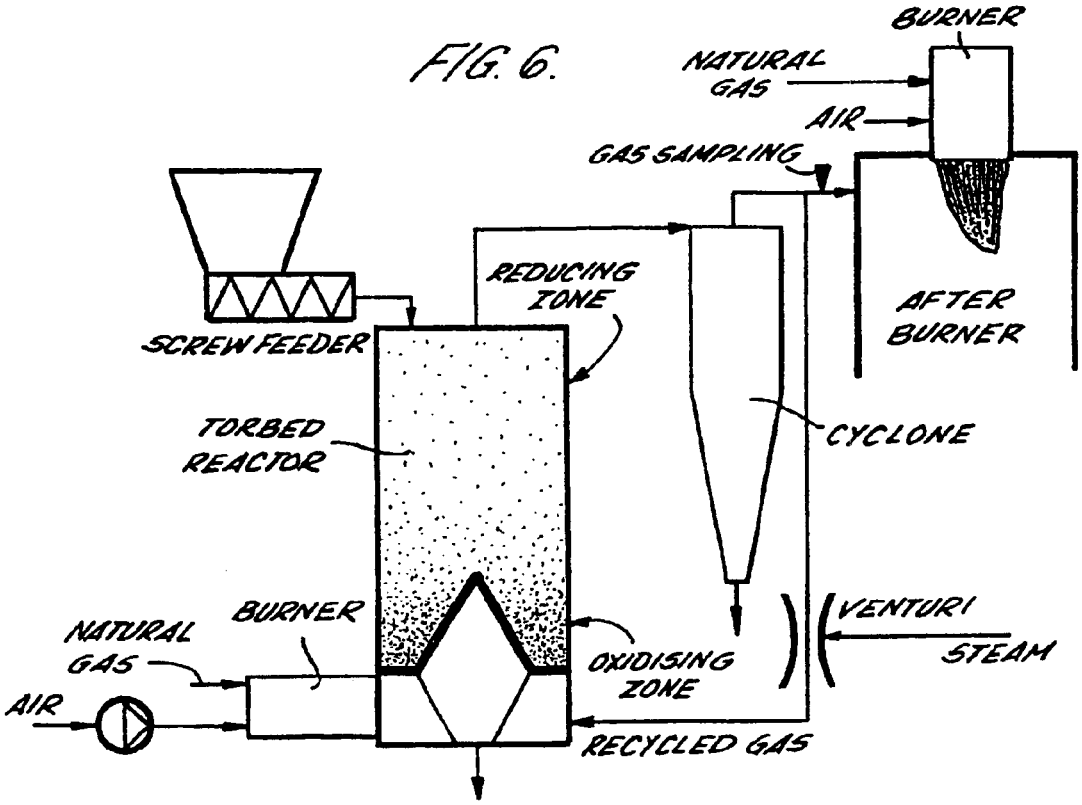
FIG. 6 is a schematic illustration of the general arrangement for Example 3 given below.

As with Examples 1 and 2, an oxidising atmosphere was created in the lower (bed) region with a reducing atmosphere in the upper (freeboard) region (see FIG. 6). Feed material was metered into the freeboard of the reactor where it came into contact with hot process gases rising from the gas distributor at the base. In this reducing region of the reactor, the flash gasification process took place generating the fuel gas and a residual char/ash particle.

While the fuel gases were expelled from the reactor, the char/ash particles continued their ascent to the above blade bed region. As this zone was operated with excess air, the char component of the particle was combusted to $CO_2$ and water to generate a reducing atmosphere and produced the heat needed to drive the gasification process in the freeboard above.

Fluidisation of the solids, which were in the form of pellets, was achieved using a mixture of recycled exhaust gas and ambient air. Having decoupled it from fluidisation requirements, the ambient air flow rate was set by the heat requirements of the system. The interface between the reducing and oxidising regions within the furnace also shifted in response to the ambient air rate. A steam driven venturi device was used to drive the exhaust gas around the recycle loop.

Tests were undertaken in a T400 (400 mm internal diameter) Torbed (RTM) reactor fitted with 45% free surface area blades. The exhaust gas recycle ratio was controlled by the capacity of the venturi, which in turn was dictated by the amount of motive steam used (FIG. 6). The flow rate of air was quantified by a portable hot-wire anemometer. To prevent fouling of the venturi and the gas distributor, the exhaust gases were passed through a high efficiency reverse flow cyclone separator. Feed material was continuously metered into the Torbed reactor via a frequency inverter controlled screw conveyor, which had a nominal range of 30 kg/h to 300 kg/h. The unit was also fitted with a plenum based natural gas burner to facilitate start-up. The reactor was also fitted with a central discharge option to cater for the removal of larger ash particles and non-organic tramp materials.

The quality of the fuel gas produced was estimated by monitoring the natural gas consumption of the after burner device. As the after burner is designed to maintain its exit temperature, any increase in the heat value of the fuel gas from the gasifier reduced natural gas consumption. In addition to this qualitative assessment, a basic exhaust analyser was also attached to the exhaust line post cyclone to measure $O_2$, $CO_2$, $H_2$ and CO.

To prepare the system for gasification, the unit was heat soaked via the agency of the main burner with no gas recycle. Once the reactor was heat soaked to around 1000° C., operation was switched to gasification mode. This transition was achieved by first enabling the recycle loop and then admitting feed. Once the quantity of organics entering the reactor with the feed exceeded the amount of oxygen available for complete combustion, the atmosphere in the upper region of the reactor become reducing initiating the gasification process. This change of operating mode was also accompanied by a reduction in temperature associated with the endothermic requirements of the gasification reactions. Further increases in feed-rate extend the reducing zone and increased the quality of the fuel gas.

The composition of the sewage sludge is given in Table 3-1 and the feed rate used during start-up was 30 kg/h.

TABLE 3-1

Composition (Typical) of Sewage Sludge

| Typical Composition | Mass % (as received basis) | Mass % (dry basis) |
|---|---|---|
| Moisture | 74 | — |
| Carbon | 7.4 | 28.3 |
| Hydrogen | 1.1 | 4.1 |
| Nitrogen | 0.8 | 3.0 |
| Oxygen | 16.5 | 63.4 |
| Sulphur | 0.3 | 1.25 |
| Ash | 11.9 | 45.8 |
| Heat Value | 860 kJ/kg | 10,600 kJ/kg |

Sewage sludge has a relatively high free-water and ash content, therefore the as-received heat value of the feed is reduced. This characteristic is reflected in the relatively high air to feed mass ratio required. Even with recycle, around 180 kg/h of air was required to generate the heat necessary to drive the gasification (and in this case drying) process. The resulting gas mixture passing through the blades had an oxygen concentration of 10.6%. The solids feed rate was around 60 kg/h. Temperatures in the lower section of the reactor averaged around 860° C., while the temperature in the upper section was 786° C. Information regarding the fuel gas produced is shown in Table 3-2.

TABLE 3-2

Exhaust gas composition-Sewage Sludge Gasification Trial

| Component | Concentration (volume % dry basis) |
|---|---|
| CO | 4.5 |
| $CO_2$ | 12 |
| $H_2$ | 5 |
| $O_2$ | 1.1 |

Recycling a portion of the exhaust gas enables the ambient air flow rate to be decoupled from solids fluidisation requirements. With less nitrogen being introduced on a per unit mass of feed basis, the quality of the fuel gas produced is significantly improved. In addition, recycling the exhaust gas enhances the cracking of larger molecular weight organics into smaller less volatile species, therefore enabling a wider range of feeds to be processed.

What is claimed is:

1. A process for the production of a gaseous fuel from a waste material and/or a premium fuel, which process comprises:

(i) providing a processing chamber having therein a plurality of outwardly radiating inclined vanes at a base thereof, an inlet and an outlet;

(ii) introducing a waste material and/or a premium fuel into the chamber through the inlet;

(iii) generating an upward flow of a heating fluid through the vanes at the base of the chamber, wherein the vanes at the base of the chamber impart a rotational motion to the heating fluid to circulate the heating fluid about a substantially vertical axis of the chamber as said fluid rises, whereby the waste material and/or the premium fuel circulate about an axis of the chamber in a compact turbulent band and is gasified and/or pyrolysed to produce a gaseous fuel stream, which gaseous fuel stream exits the chamber through the outlet; and (iv) feeding at least a portion of the gaseous fuel stream back into the chamber through an entry point adjacent the vanes.

2. A process as claimed in claim 1, wherein from 10 to 100% by volume of the gaseous fuel stream is fed back into the chamber.

3. A process as claimed in claim 1, wherein the said at least portion of the gaseous fuel stream is reintroduced into the chamber at an entry point below the vanes of the chamber.

4. A process as claimed in claim 3, wherein the said at least portion of the gaseous fuel stream is reintroduced into the chamber through one or more venturi inlets positioned below the vanes of the chamber.

5. A process as claimed in claim 1, wherein the said at least portion of the gaseous fuel stream is mixed with steam prior to being reintroduced into the chamber.

6. A process as claimed in claim 1, wherein the inlet for the waste material and/or the premium fuel is located adjacent the base of the chamber and the outlet is spaced downstream from the inlet.

7. A process as claimed in claim 1, wherein the inlet for the waste material and/or the premium fuel is located at a position above the vanes of the chamber.

8. A process as claimed in claim 1, wherein the waste material and/or premium fuel comprises a solid and/or liquid material.

9. A process as claimed in claim 1, wherein the waste material comprises one or more of sewage sludge, by-product waste, waste wood, wood shavings, clean wood, agricultural waste, animal litter, municipal solid waste and/or refuse-derived fuel.

10. A process as claimed in claim 1, wherein the premium fuel comprises one or more of coal, petrochemical derivatives and/or residues from refineries.

11. A process as claimed in claim 1, wherein the waste material and/or the premium fuel is introduced into the processing chamber by injecting it through the inlet under the influence of a compressed gas or by a gravity feed mechanism.

12. A process as claimed in claim 1, wherein the heating fluid comprises steam and/or a gas stream produced by combustion of a fuel.

13. A process as claimed in claim 1, wherein the processing chamber contains a resident bed of particulate material which circulates about an axis of the chamber when the flow of the heating fluid is generated.

14. A process as claimed in claim 13, wherein the particulate material comprises a solid absorbent material for removal of acidic gases from the gaseous fuel stream exiting the processing chamber.

15. A process as claimed in claim 13, wherein the particulate material of the resident bed comprises a catalytic material.

16. A process as claimed in claim 15, wherein the catalytic material acts to increase the rate of tar decomposition in the gaseous fuel stream.

17. A process as claimed in claim 13, wherein the particulate material comprises one or more of dolomite, a nickel-bearing catalyst, a zeolite, a magnesium-calcium carbonate, and/or a calcined magnesium-carbonate.

18. A process as claimed in claim 1, wherein the heating fluid is at a temperature in the range of from 300 to 1000° C.

19. A process as claimed in claim 1, wherein a portion of the gaseous fuel stream which has exited the chamber is collected during each processing cycle.

20. A process as claimed in claim 1, wherein the gaseous fuel stream produced from the waste material and/or the premium fuel is subjected to one or more further processing steps selected from particulate removal, drying, compression and/or sweetening.

21. A process as claimed in claim 1, wherein the pressure drop through the chamber is less than 400 Pa.

22. A process as claimed in claim 1, wherein the said at least portion of the gaseous fuel stream is fed back into the chamber without the assistance of supplemental pumping means.

23. An apparatus for carrying out the process as defined in claim 1, the apparatus comprising:

(a) a processing chamber having therein a plurality of outwardly radiating inclined vanes at a base thereof, an inlet and an outlet;

(b) means for introducing a waste material and/or a premium fuel into the chamber through the inlet;

(c) means for generating an upward flow of a heating fluid through the vanes at the base of the chamber, whereby, in use, the waste material and/or the premium fuel circulate about an axis of the chamber in a turbulent band and is gasified and/or pyrolysed to produce a gaseous fuel stream, which gaseous fuel stream exists the chamber through the outlet; wherein the means for generating an upward flow of a heating fluid is a base with a circular arrangement of overlapping vanes, wherein each vane is inclined relative to the base and (d) means for feeding at least a portion of the gaseous fuel stream back into the chamber through an entry point adjacent the vanes.

24. An apparatus as claimed in claim 23, wherein the vanes radiate outwardly from a central point toward the vertical wall of the chamber and form part of a circular disk.

* * * * *